US008408526B2

(12) United States Patent
Fujii

(10) Patent No.: US 8,408,526 B2
(45) Date of Patent: Apr. 2, 2013

(54) CARBURETOR WITH STARTING FUEL SUPPLY MECHANISM

(75) Inventor: Kazuhiro Fujii, Kanagawa-ken (JP)

(73) Assignee: Nikki Co., Ltd., Atsugi (JP)

( * ) Notice: Subject to any disclaimer, the term of this patent is extended or adjusted under 35 U.S.C. 154(b) by 375 days.

(21) Appl. No.: 12/801,386

(22) Filed: Jun. 7, 2010

(65) Prior Publication Data

US 2010/0320625 A1 Dec. 23, 2010

(30) Foreign Application Priority Data

Jun. 19, 2009 (JP) ..... 2009-146125

(51) Int. Cl.
*F02M 1/16* (2006.01)

(52) U.S. Cl. ..... 261/50.1; 261/50.2; 261/64.6

(58) Field of Classification Search ..... 261/50.1, 261/50.2, 64.6, DIG. 8, DIG. 73
See application file for complete search history.

(56) References Cited

U.S. PATENT DOCUMENTS 3,978,175 A * 8/1976 Stoltman ..... 261/50.2
4,206,735 A * 6/1980 Miles et al. ..... 123/464
4,276,239 A * 6/1981 Yoshikawa et al. ..... 261/44.6
4,279,841 A * 7/1981 Stettner ..... 261/23.2
4,331,616 A * 5/1982 Kato et al. ..... 261/50.2
4,359,433 A * 11/1982 Hartel ..... 261/142
4,478,764 A * 10/1984 Ii et al. ..... 261/50.2
5,176,855 A * 1/1993 Jones ..... 261/39.3
6,283,460 B1 * 9/2001 Omarsson ..... 261/50.1
7,278,629 B2 * 10/2007 Nonaka ..... 261/50.1

FOREIGN PATENT DOCUMENTS

JP 2002-339804 11/2002

* cited by examiner

*Primary Examiner* — Richard L Chiesa
(74) *Attorney, Agent, or Firm* — Rader, Fishman & Grauer PLLC

(57) ABSTRACT

A carburetor with a starting fuel supply mechanism which additionally supplies a starting fuel at the start of an engine includes a choke valve in suction passages extending through a main body; and a starting fuel supply path disposed as a bypass of a main fuel passage to connect a float chamber to the suction passages, the starting fuel supply path being provided with an opening/closing valve opened by interlocking with the closing operation of the choke valve, and a valve body of the choke valve which performs the closing operation presses valve opening/closing device while abutting on one end of the valve opening/closing device, to open the opening/closing valve of the starting fuel supply path, so that the starting fuel can be prepared to be supplied.

3 Claims, 4 Drawing Sheets

CARBURETOR WITH STARTING FUEL SUPPLY MECHANISM

BACKGROUND OF THE INVENTION

1. Field of the Invention

The present invention relates to a carburetor with a starting fuel supply mechanism. More particularly, it relates to a carburetor with a starting fuel supply mechanism which interlocks with the closing operation of a choke valve to open a starting fuel supply path, thereby supplying a starting fuel in addition to a usually supplied fuel at the start of an engine.

2. Description of Related Art

In a carburetor provided with a choke mechanism used for a general-purpose engine or the like, to adjust the air-fuel ratio of an air-fuel mixture to a start air-fuel ratio at the cold start of the engine, the engine is usually started while the totally closed state or arbitrary open degree of a choke valve is secured. In this case, when the flow rate of a fuel discharged through a main nozzle during cranking does not satisfy an engine demand flow rate, a start defect or inability to start is caused, and hence an extra time is something required for complete explosion.

To solve these problems, Japanese Patent Application Laid-Open No. 2002-339804 suggests a carburetor with a starting fuel supply mechanism comprising a starting fuel supply path disposed as a route other than a main fuel passage, to connect a float chamber to a suction passage. An opening/closing valve is disposed in the starting fuel supply path, and a link rod is interposed so as to connect the opening/closing valve to a choke lever, thereby opening the opening/closing valve of the starting fuel supply path with the closing operation of the choke lever.

In this way, the starting fuel supply mechanism is disposed which can prepare a starting fuel to be supplied by interlocking with the opening of the choke valve and which supplies the starting fuel through the starting fuel supply path as a bypass of the main fuel passage, whereby it is possible to avoid a situation in which the supplied fuel runs short at the cold start of the engine.

However, in the starting fuel supply mechanism suggested in the above document, the opening/closing valve of the starting fuel supply path formed in the carburetor is opened and closed on the side of the tip of the link rod connected to the choke lever disposed outside the carburetor. The constitution of the mechanism is complicated, and additionally the number of processing processes for manufacturing the carburetor and the number of components are increased. Therefore, this technology is not easily employed broadly in the carburetor for the general-purpose engine where the simplicity of the constitution and the decrease of cost are demanded.

SUMMARY OF THE INVENTION

The present invention has been developed to solve the above problems, and an object thereof is to acquire satisfactory engine start properties without incurring any steep cost rise in a simple constitution of a carburetor with a starting fuel supply mechanism.

To achieve the above object according to the present invention, there is provided a carburetor with a starting fuel supply mechanism which additionally supplies a starting fuel at the start of an engine, comprising: a choke valve in suction passages extending through a main body; and a starting fuel supply path disposed as a bypass of a main fuel passage to connect a float chamber to the suction passages, the starting fuel supply path being provided with an opening/closing valve opened by interlocking with the closing operation of the choke valve, characterized in that the starting fuel supply mechanism comprises valve opening/closing means having one end projecting to the suction passages and the other end connected to a valve body of the opening/closing valve of the starting fuel supply path, and a valve body of the choke valve which performs the closing operation in the suction passages presses the valve opening/closing means while abutting on the one end of the valve opening/closing means, whereby the valve opening/closing means is moved to open the opening/closing valve of the starting fuel supply path, so that the starting fuel is prepared to be supplied.

In this way, the valve body of the choke valve abuts on the one end of the valve opening/closing means with the closing operation of the choke valve, to open the opening/closing valve of the starting fuel supply path, and a constitution is simplified as compared with a conventional example having a constitution in which the opening/closing valve of the starting fuel supply path in the carburetor is opened on the side of the tip of a link rod connected to a choke lever.

Moreover, in this case, the valve opening/closing means of the starting fuel supply mechanism is a valve rod having a tip connected to the valve body of the opening/closing valve and having a base end provided with a valve body abutment portion on which a part of the valve body of the choke valve abuts and provided with a valve spring which urges the opening/closing valve in a valve closing direction, and the valve opening/closing means keeps the closed state of the opening/closing valve in a state where the valve body of the choke valve does not abut on the valve body abutment portion.

Furthermore, in the above carburetor with the starting fuel supply mechanism, the starting fuel supply mechanism comprises a fuel pump-up tube vertically provided at a position lower than a fuel level in the float chamber so that the tip of the tube is opened, and the starting fuel supply mechanism is integrated as one component together with the fuel pump-up tube, the opening/closing valve and the valve opening/closing means and attached to the carburetor. According to the constitution, the starting fuel supply mechanism is simply attached to a conventional carburetor, whereby the carburetor with the starting fuel supply mechanism can easily be manufactured.

The valve body of the choke valve performs the closing operation to abut on the valve body abutment portion of the starting fuel supply mechanism, thereby pressing the valve body abutment portion to open the opening/closing valve of the starting fuel supply path. According to the present invention, it is possible to acquire satisfactory engine start properties without incurring any steep cost rise in a simple constitution.

DESCRIPTION OF THE PREFERRED EMBODIMENTS

Hereinafter, a configuration for carrying out the present invention will be described with reference to the drawings.

Figure 1:
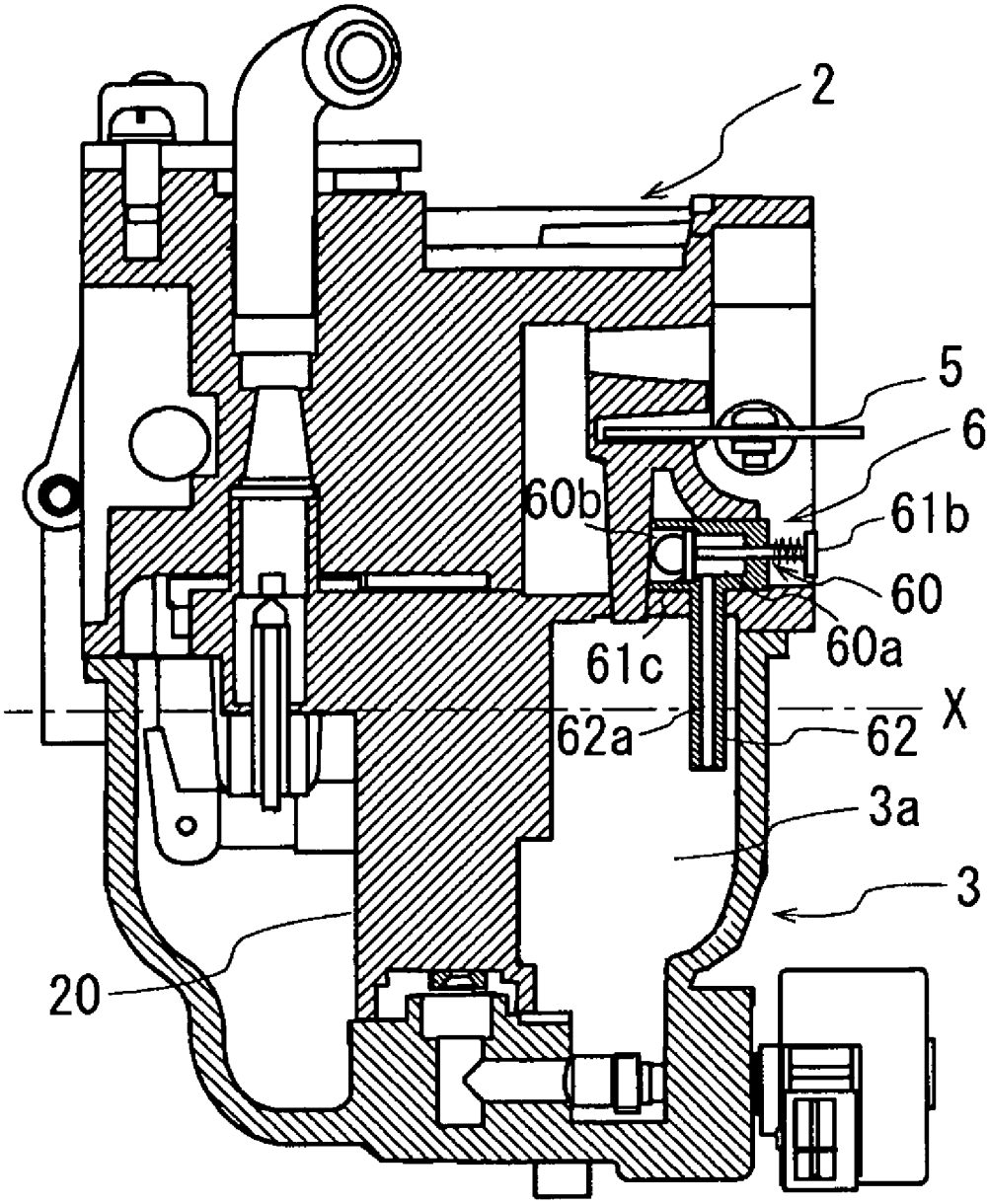
FIG. 1 is a vertical sectional view of a carburetor with a starting fuel supply mechanism which is an embodiment in the present invention.
Figure 2:
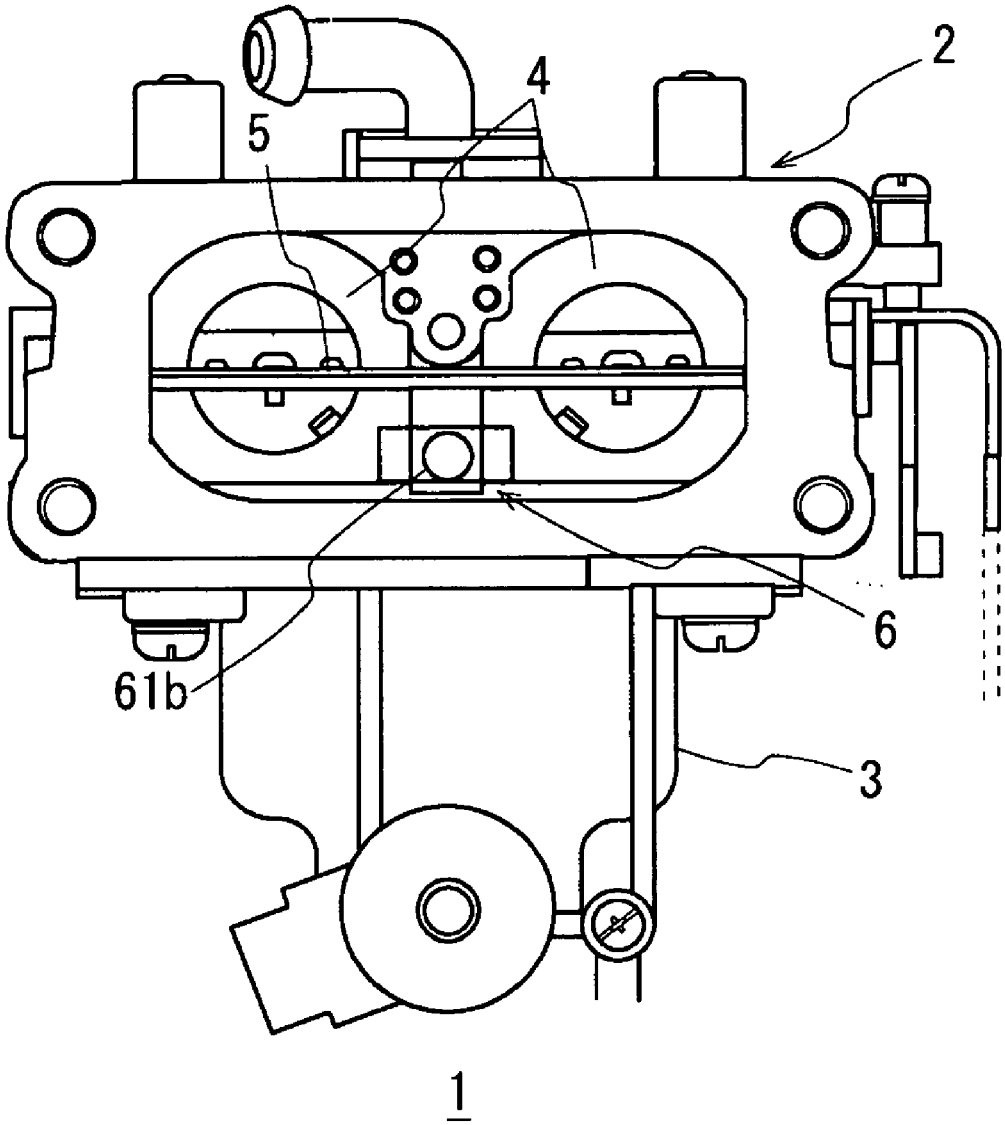
FIG. 2 is a right side view of the carburetor with the starting fuel supply mechanism of FIG. 1.

FIG. 1 shows a vertical sectional view of a carburetor 1 with a starting fuel supply mechanism 6 which is an embodiment in the present invention, and FIG. 2 shows a right side view thereof. In the present embodiment, the carburetor 1 which is a two-barrel carburetor used for a general-purpose engine or the like will be described, and the carburetor has a constitution similar to a conventional general-purpose two-barrel carburetor except that the carburetor is provided with the starting fuel supply mechanism 6 integrated as one component.

That is, a float chamber 3 constituting a float space 3*a* is provided on the side of the undersurface of a main body 2 through which suction passages 4 and 4 disposed in parallel extend horizontally, and a columnar member 20 including a main fuel passage (not shown) is provided vertically from the undersurface of the main body 2 in the float space 3*a*, whereby a fuel stored in the float space 3*a* is discharged to the suction passages 4 and 4 owing to a negative pressure generated by the rotation of the engine.

Moreover, the starting fuel supply mechanism 6 which is a characteristic part of the present invention is disposed under a valve body 5 constituting a choke valve between the two parallel suction passages 4 and 4 of the main body 2. The starting fuel supply mechanism 6 comprises a main body part 60 in which a starting fuel supply path and an opening/closing valve of the path are disposed, and a fuel pump-up tube 62 extended downward from the undersurface of the main body part, and the mechanism connects the float space 3*a* to the suction passages 4 and 4 to supply the starting fuel at the start of the engine.

Figure 3:
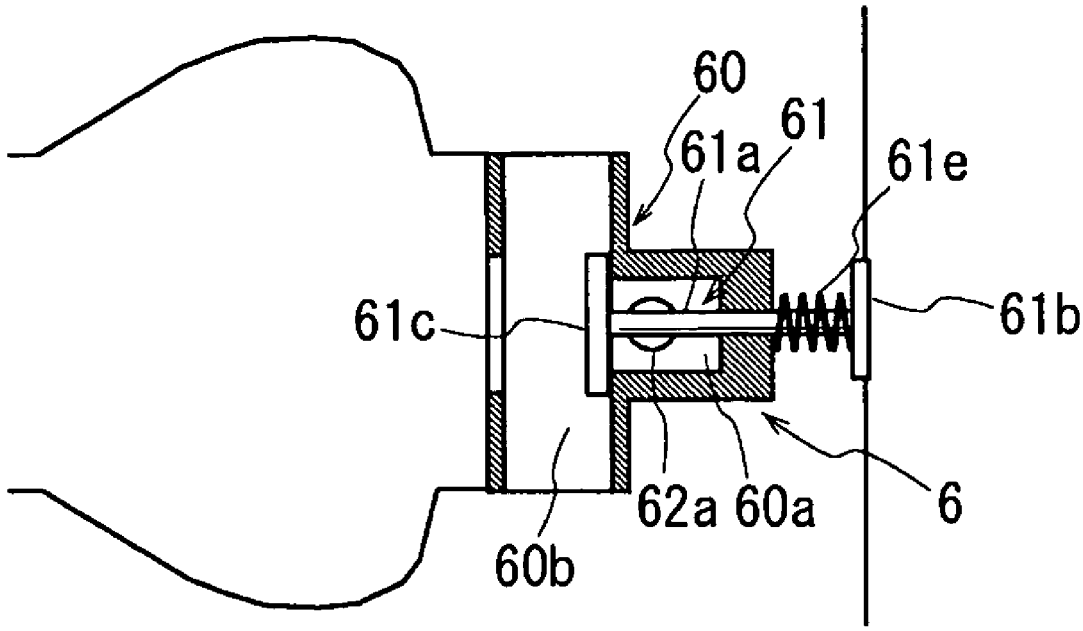
FIG. 3 is a partially enlarged transverse sectional view of the starting fuel supply mechanism in the carburetor with the starting fuel supply mechanism of FIG. 1.

That is, as shown in a partially enlarged transverse sectional view (plan view) of FIG. 3, the starting fuel supply mechanism 6 comprises valve opening/closing means 61 directed transversely and provided slidably in a longitudinal direction in the housing-like main body part 60 in which a cavity is disposed. A valve rod 61*a* constituting the valve opening/closing means 61 has a flat-plate-like valve body abutment portion 61*b* at one end thereof, and a valve body 61*c* at the other end in the main body part 60. When the valve body 5 of the choke valve disposed above the mechanism is operated at a valve closing position, the valve body abuts on the valve body abutment portion 61*b* to press the valve body abutment portion 61*b*, thereby moving the valve body 61*c* in a valve opening direction.

Moreover, the valve opening/closing means 61 is provided with a valve spring 61*e* interposed between the back surface side of the valve body abutment portion 61*b* provided perpendicularly with respect to the axis of the valve rod 61*a* and the side surface of the main body part 60, to urge the valve rod 61*a* in the valve closing direction of the valve body 61*c*. When the valve body 5 of the choke valve does not abut on the valve body abutment portion, the valve body 61*c* closes the starting fuel supply path connecting the float space 3*a* to a suction passage 4 side.

On the other hand, the main body part 60 of the starting fuel supply mechanism 6 comprises a first chamber 60*a* where an in-tube passage 62*a* of the fuel pump-up tube 62 opens, and a second chamber 60*b* which opens on the side of the left and right suction passages 4 and 4. The in-tube passage 62*a*, the first chamber 60*a* and the second chamber 60*b* constitute the starting fuel supply path, and the valve body 61*c* constitutes the opening/closing valve together with an opening peripheral edge side where the first chamber 60*a* opens on the side of the second chamber 60*b*.

Figure 4A:
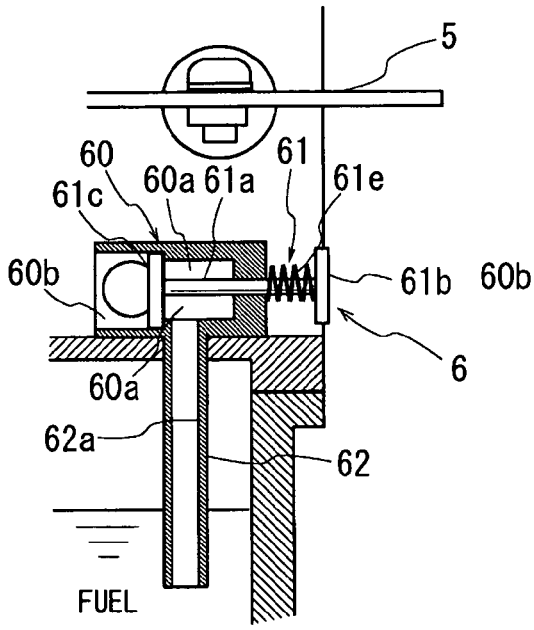
FIG. 4A is a partially enlarged vertical sectional view showing a state before the operation of the starting fuel supply mechanism in the carburetor with the starting fuel supply mechanism of FIG. 1.

Next, the operation of the starting fuel supply mechanism 6 which is the characteristic part of the carburetor 1 with the starting fuel supply mechanism of the present embodiment will be described with reference to FIGS. 4A and 4B. As shown in FIG. 4A, in a stage before the start of the engine, the choke valve is opened, and the starting fuel supply path formed in the starting fuel supply mechanism 6 is closed with the opening/closing valve.

Figure 4B:
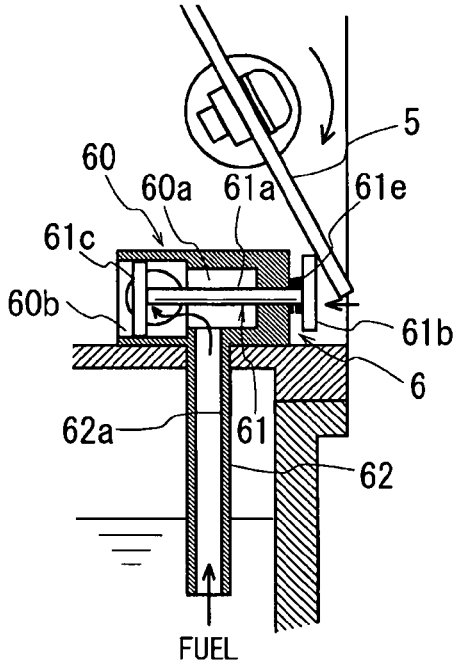
FIG. 4B is a partially enlarged vertical sectional view showing a state during the operation of the starting fuel supply mechanism of FIG. 4A.

Subsequently, as shown in FIG. 4B, an operation of closing the choke valve is performed at the cold start of the engine, to rotate the valve body 5 of the choke valve, and the edge of the valve body abuts on the valve body abutment portion 61*b* of the valve opening/closing means 61 to press the valve body abutment portion 61*b*, whereby the valve body 61*c* is moved in the valve opening direction to open the starting fuel supply path which connects the float space 3*a* to the suction passages 4.

In consequence, cranking is performed at the cold start of the engine, and the negative pressure of the suction passages 4 is generated with the rotation of the engine, whereby the fuel in the float space 3*a* is sucked out to the suction passages 4 and 4 through the in-tube passage 62*a* of the fuel pump-up tube 62, the first chamber 60*a* and the second chamber 60*b*. Therefore, a completely exploded air-fuel mixture required at the cold start can be obtained, thereby achieving satisfactory start.

On the other hand, after the start of the engine, the choke valve is opened, thereby releasing the valve body abutment portion 61*b* of the valve opening/closing means 61 which has been pressed by the valve body 5, and the opening/closing valve of the starting fuel supply path is closed by the urging force of the valve spring 61*e*, so that the fuel is not sucked out to the suction passages 4 and 4 through this route. In this way, the starting fuel supply mechanism 6 integrated as one component and having a simple constitution is only provided in the conventional carburetor, so that the secure start of the engine can be realized at the cold start.

As described above, according to the present invention, satisfactory engine start properties can be acquired without incurring any steep cost rise in the simple constitution of the carburetor with the starting fuel supply mechanism.

The invention claimed is:

1. A carburetor with a starting fuel supply mechanism which additionally supplies a starting fuel at the start of an engine, comprising:

a choke valve in suction passages extending through a main body: and a starting fuel supply path disposed as a bypass of a main fuel passage to connect a float chamber to the suction passages. the starting fuel supply path being provided with an opening/closing valve opened by interlocking with the closing operation of the choke valve, wherein the starting fuel supply mechanism comprises valve opening/closing means having one end projecting to the suction passages and having the other end connected to a valve body of the opening/closing valve, and a valve body of the choke valve which performs the closing operation in the suction passages presses the valve opening/closing means while abutting on the one end of the valve opening/closing means, whereby the valve opening/closing means is moved to open the opening/closing valve of the starting fuel supply path, so that the starting fuel is prepared to be supplied and wherein the valve opening/closing means is a valve rod having a tip connected to the valve body of the opening/closing valve and having a base end provided with a valve body abutment portion on which a part of the valve body of the choke valve abuts and provided with a valve spring which urges the opening/closing valve in a valve closing direction, and the valve opening/closing means keeps the closed state of the opening/closing valve in a state where the valve body of the choke valve does not abut on the valve body abutment portion.

2. The carburetor with the starting fuel supply mechanism according to claim 1, wherein the starting fuel supply mechanism comprises a fuel pump-up tube vertically provided at a position lower than a fuel level in the float chamber so that the tip of the tube is opened, and the starting fuel supply mechanism is integrated as one component together with the fuel pump-up tube, the opening/closing valve and the valve opening/closing means and attached to the main body.

3. The carburetor with the starting fuel supply mechanism according to claim 1, wherein the starting fuel supply mechanism comprises a fuel pump-up tube vertically provided at a position lower than a fuel level in the float chamber so that the tip of the tube is opened, and the starting fuel supply mechanism is integrated as one component together with the fuel pump-up tube, the opening/closing valve and the valve opening/closing means and attached to the main body.

* * * * *